US005806993A

United States Patent [19]

Petterutti et al.

[11] Patent Number: 5,806,993

[45] Date of Patent: Sep. 15, 1998

[54] PORTABLE INTERACTIVE MINIATURE PRINTER

[75] Inventors: Steven Petterutti, East Greenwich; Majid Amani, Coventry; David F. Beck, Exeter, all of R.I.

[73] Assignee: Comtec Information Systems, Inc., Warwick, R.I.

[21] Appl. No.: 819,746

[22] Filed: Mar. 18, 1997

[51] Int. Cl.[6] ..... B41J 3/39

[52] U.S. Cl. ..... 400/88; 400/613

[58] Field of Search ..... 400/88, 120 HH, 400/279, 320, 322, 613

[56] References Cited

U.S. PATENT DOCUMENTS

| | | | |
|---|---|---|---|
| 4,108,706 | 8/1978 | Brands et al. | 156/384 |
| 4,468,274 | 8/1984 | Adachi | 156/320 |
| 4,497,682 | 2/1985 | Hamisch, Jr. | 156/384 |
| 4,614,949 | 9/1986 | Hakkaku et al. | 400/246 |
| 4,707,221 | 11/1987 | Shibata | 156/354 |
| 4,784,714 | 11/1988 | Shibata | 156/354 |
| 4,896,166 | 1/1990 | Barker et al. | 346/76 PH |
| 4,910,602 | 3/1990 | Sakuragi | 400/207 |
| 4,938,616 | 7/1990 | Shiozaki et al. | 346/76 PH |
| 4,947,185 | 8/1990 | Mitsushima et al. | 346/76 PH |
| 5,036,338 | 7/1991 | Imai | 346/76 PH |
| 5,265,966 | 11/1993 | Schmidt | 400/55 |
| 5,267,800 | 12/1993 | Petteruti et al. | 400/88 |
| 5,366,302 | 11/1994 | Masumura et al. | 400/120.16 |
| 5,487,337 | 1/1996 | Uland | 101/288 |
| 5,497,701 | 3/1996 | Uland | 101/288 |
| 5,524,993 | 6/1996 | Durst | 400/279 |
| 5,560,293 | 10/1996 | Boreali et al. | 400/621 |

*Primary Examiner*—Edgar S. Burr
*Assistant Examiner*—Steven S. Kelley
*Attorney, Agent, or Firm*—M. Lukacher; K. Lukacher

[57] ABSTRACT

An intelligent, portable printer having a microprocessor controller, a printing mechanism, and a web feed mechanism integrated into an assembly which, together with a battery pack, may weigh about 1.5 pounds and be about 60 cubic inches in volume. The web may have removable labels adhesively attached to a liner, or it may be linerless label stock with exposed adhesive, or it may be non-adhesive plain paper stock. The web may be printed with bar codes, graphics, text, or lines. Because the printer is so small and light in weight, it may be used at any site where labels are required. By labels is meant any tickets, stickers, or other patches (so-called "label-stock"). The controller includes a microprocessor which communicates interactively with a terminal, which may be remote from the printer and may include or be a host computer, via cable, radio, or optical interfaces. The terminal supplies application programs and data representing the information to be printed. The controller in the printer converts such data into printing formats for operating the printer mechanism. The state of the printer is communicated to the terminal and both operate interactively to produce labels. The printer can operate in a network of portable printers and terminals.

39 Claims, 9 Drawing Sheets

PORTABLE INTERACTIVE MINIATURE PRINTER

The present invention relates to printers which are operated by digital data, and particularly to a miniature, portable, intelligent printer which is interactive with a terminal which supplies applications programs and data representing information to be printed to the printer.

A printer provided by the invention is especially suitable for use in portable printing to print labels (by which is meant shelf labels, tickets, stickers, and other patches) which may be adhesively, releasably attached to a web carrier (so-called "label-stock") or which may comprise a strip of continuous label material wound in roll form without a web carrier (so-called "linerless stock"). Such printing can be performed on site (in the warehouse, retail store, or factory where labels are required) because the printer is portable and miniature in size, and because the printer can communicate with a host terminal via radio or optical interface and therefore does not require a cable connection. A printer provided by the invention may occupy a volume of about 60 cubic inches or less, may weigh about 1.5 pounds or less, and may be operated in a network of such portable printers and terminals.

Label printers have been used on factory floors, in warehouses, and in retail establishments for ticket printing and inventory control. Since the printers are portable and may be carried on the person of the user, it is desirable that the size and weight thereof be minimized.

More recently, smaller printers have been proposed, especially for use with linerless label stock. However, such printers may not be easily portable.

In one type of linerless stock, the adhesive side of the strip is releasable from the face side of the next convolution of the roll, similar to a roll of adhesive tape. When unwound, such stock can be difficult to convey through a printer and can foul the apparatus during use through build-up of transferred adhesive.

U.S. Pat. Nos. 4,707,211 issued Nov. 17, 1987 to Shibata and 4,784,714 issued Nov. 15, 1988 to Shibata disclose a desk-top printer for printing linerless label stock. The device avoids the problems inherent in conveying tacky stock by using a special label stock having a thermally-activatable adhesive, requiring a special heating section in the printer. This can add to the cost, complexity, size, and weight of the printer.

U.S. Pat. No. 4,468,274 issued Aug. 28, 1984 to Adachi discloses use of a thermally-activatable adhesive and proposes a heat-transferable conveyor for conveying the tacky stock through the printer.

U.S. Pat. No. 5,560,293 issued Oct. 1, 1996 to Boreali et al. discloses a linerless label printer and transport system wherein tacky web may be conveyed. All the substantially stationary printer components which may come into contact with the tacky surface, such as a label guide, transport plate, front panel, and stripper blade, have the adhesive-facing surfaces plasma coated. Plasma coating of parts can add significantly to the manufacturing cost of the printer.

U.S. Pat. No. 4,108,706 issued Aug. 22, 1978 to Brands et al. teaches to use vacuum to hold and advance tacky labels through a label printer. Vacuum conveyance can add complexity, size, weight, and cost to such a printer.

U.S. Pat. Nos. 5,267,800 issued Dec. 7, 1993 to Petteruti et al. and 5,524,993 issued Jun. 11, 1996 to Durst disclose an automatic print speed control for a barcode printer including a printhead to which power is applied during a strobe time to cause the printhead to print The printer also includes a stepper drive motor that is responsive to a drive signal derived from a number of measured operating variables of the printer to adjust automatically the printhead strobe time. The printer lacks the ability, however, for a user to input settings in real time for additional subjective variables such as contrast and tone, or to override the measured operating values, which can be a serious shortcoming when a user desires some printing effect other than that which the control system automatically provides. In addition, the sensor lens of a paper-presence detector in 5,524,993 is contacted by the label stock passing through the printer and can be fouled and rendered inoperative by build-up of material transferred from the stock.

U.S. Pat. No. 5,267,800, ('800) which is herein incorporated by reference, discloses an intelligent, interactive, portable printer having a microprocessor controller, a printing mechanism, and a web feed mechanism integrated into an assembly which together with a battery pack, may weigh about 2 pounds and be about 80 cubic inches in volume. The microprocessor communicates interactively with a terminal, which may contain a host computer and which supplies programs and data representing the information to be printed. The controller in the printer converts such data into bar codes, graphics, text, or lines for operating the printer mechanism. The state of the printer is communicated to the terminal and both operate interactively to produce labels. The terminal may be, for example, a cash register with its associated input device such as an optical character recognition device, bar code scanner, or magnetic stripe reader. The terminal may be connected to the printer via a hard wire, radio (RF), or optical link. The printer disclosed in '800 is intended expressly for use with label stock having a liner and is not suited for use with either tacky or heat-activated linerless label stock.

It is the principal object of the present invention to provide an improved printer having the excellent features of the '800 printer and which can print either linered or linerless label stock interchangeably without need for prior art plasma coating of printer parts, special heat-activating sections, or vacuum conveyance apparatus.

It is a further feature of the present invention that an improved miniature printer weighs less than about 1.5 pounds and occupies a volume of about 60 cubic inches.

It is a still further feature of the present invention that an improved printer is easy to load and to thread with a new roll of label stock.

It is a still further feature of the present invention that an improved printer can manage print head energy in response to objective operating variables including head temperature, head resistance rank, battery voltage, dot density, and motor speed, as well as additional user defined settings such as, for example, contrast and tone, and user-imposed overrides.

It is a still further feature of the present invention that an improved printer has a housing having water resistant seals between a cover and a case.

It is a still further feature of the invention that an improved printer has a non-contact paper-presence sensor which is not subject to fouling by materials build-up from the label stock.

It is a still further feature of the invention that an improved printer can incorporate a radio transceiver module to eliminate the requirement for cable connection of the printer to a host computer or terminal for communication therebetween.

Briefly described, a printer embodying the invention is responsive to data representing the information to be printed and to control commands which are communicated to the printer from a terminal. The printer has a printing mechanism including printing elements. The printer includes a receptacle in the form of a well for receiving a roll of web stock up to 2 inches in width on which printing is carried out. This web stock may carry labels at successive positions along the length thereof which are releasably, adhesively attached to the web (also known as a "liner") and are removable after printing by a peeling mechanism provided by the invention. Alternatively, the web stock may be linerless with a tacky adhesive backing or may be a plain paper ribbon without adhesive.

The printer includes an openable housing having a top cover preferably hingeably attached to a case. The printing mechanism has means for feeding the stock through the printer elements, including a driven platen roller mounted in the case around which the stock is entrained. The printing elements of the mechanism may be thermal printing elements, preferably mounted in a flexural assembly, which biases the printer elements to bear on the label side of the stock and press the stock against the platen roller when the top cover is closed. The printing elements may be resiliently mounted to provide a fixed pressure of the printing elements against the platen roller and to prevent the printing process from being affected by external pressure on the cover. The flexural assembly within the top cover is less complex than the internal coil spring mechanism described in U.S. Pat. No. 4,497,682 issued Feb. 5, 1985 to Hamisch, Jr. The platen roller is driven by a drive motor to advance the label stock through the printer in coordination with the printing signals sent to the print head. No web guides or conveyance rollers are required within the printer, the platen roller being the only conveyance element to contact the web prior to printing. The surface of the platen roller comprises a release agent, preferably a silicone polymer, which prevents linerless stock from sticking to the roller.

After printing, the printed linerless or plain paper labels may pass over a peeler bar and directly out of the machine through a first exit opening formed between the case and the top cover. The peeler bar is positioned adjacent to the platen roller. For linered label stock after printing, the web liner is separated from the label by being turned through an obtuse angle around the peeler bar and is fed through a nip between the platen roller and a nip roller adjacent thereto. The surface of the nip roller may be provided with one or more annular ridges to provide good traction of the web liner against the platen roller. As the stock is advanced by the platen roller, the label is driven over a first exit lip in the first exit opening in the front wall of the case, which lip may be ribbed. At the same time, the web liner is passed through a second opening in the front wall of the case below the first opening and may be discarded.

The printer also includes an electronic controller responsive to an application program downloaded from the terminal and to data for operating the printer mechanism. The printer mechanism has sensors and outputs which represent its status. The controller is interactive with the printer and has means for transmitting status messages representing the state of the printer to the terminal.

The printer housing contains the printing mechanism, the well in which a roll of stock is received, the controller, and all of the other stock drive and handling facilities of the printer. The housing may have a key pad on a surface thereof, preferably on the top cover, and may receive a battery pack having batteries for operating the print mechanism and the controller. The housing may have water-resistant seals on mating surfaces between the top cover and the case.

The housing and all of the above-mentioned components thereof comprise a self-contained integrated assembly. The weight of the assembly can be about 1.5 pounds (e.g., 1.35 pounds) and its volume can be about 60 cubic inches (e.g., 3 inches by 4 inches by 5 inches), or about 75 cubic inches including an optional radio control pack for fully wireless operation. Notwithstanding the small size and low weight of the printer, it has all of the functions necessary for on-floor or on-site portable printing and thus constitutes a miniature, portable, interactive, and intelligent printer.

The foregoing and other objects, features, and advantages of the invention, as well as a presently preferred embodiment thereof, will become more apparent from a reading of the following description in connection with the accompanying drawings in which.

Figure 1:
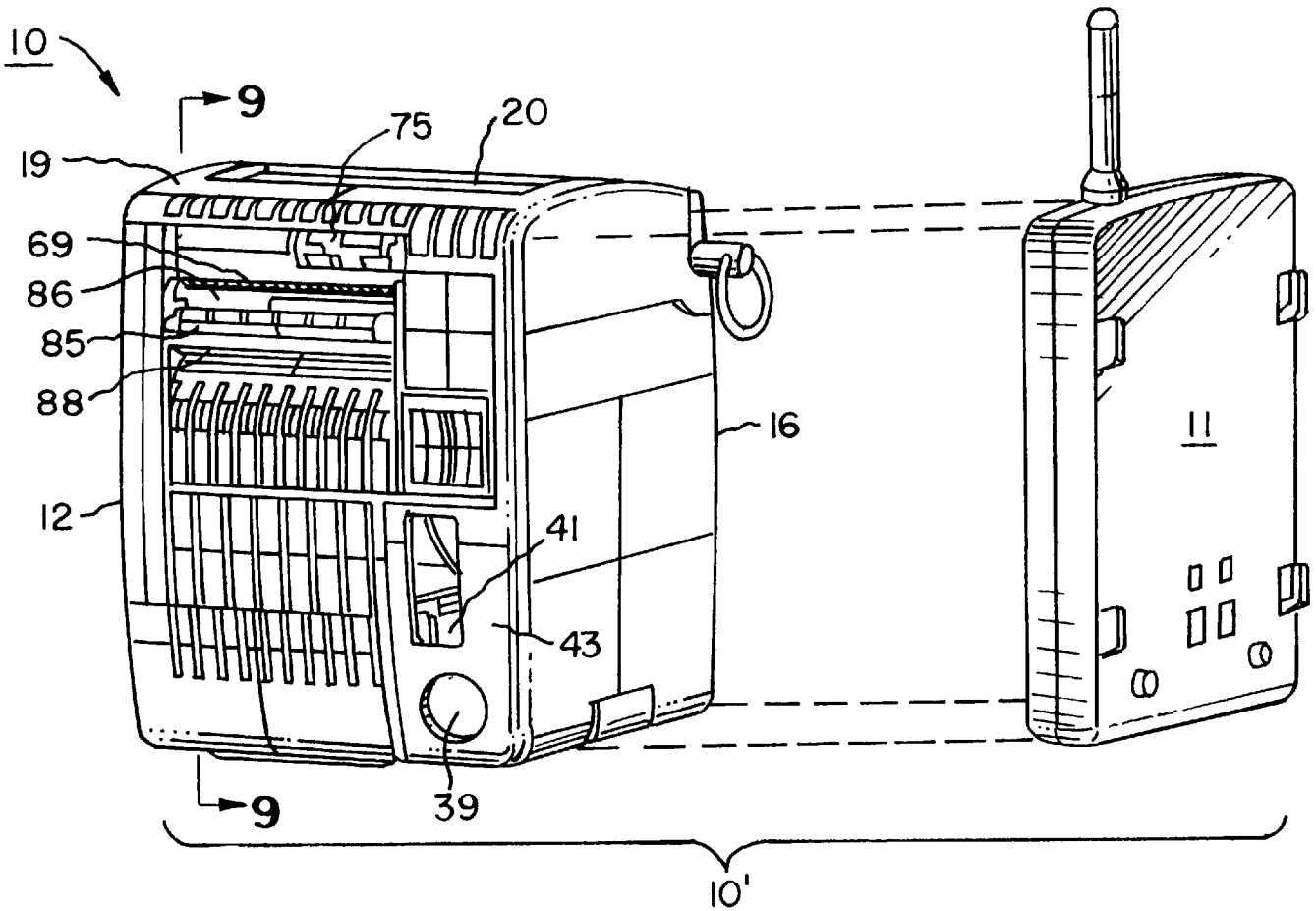
FIG. 1 is a perspective view showing the front, top, and one side of a printer in accordance with the invention, with an associated wireless (RF) control pack.

Referring to FIGS. 1 through 4 and 9, there is shown a miniature printer 10 having a housing 12 which is generally rectangular in shape. The housing is made of left and right case shells 14 and 16, respectively, molded of plastic material, preferably polycarbonate. A gasket plate 15 is disposed between shells 14 and 16. The housing includes a top cover assembly 18 which includes a top cover shell 19 on which is disposed a key pad 20. A controller assembly 22 is disposed within right shell 16 and is connected to key pad 20 via a multi-channel ribbon cable 17. Preferably, cover 18 is openably connected to shells 14 and 16 by a hinge 24 which includes a hinge pin 26 received by guides 28 in the case and bushings 30 in the cover, being secured by split rings 32 through the bushings. These rings may be connected to a strap or chain (not shown) which may be used to connect the printer to the belt of the operator or may be extended to carry the printer on the operator's shoulder.

Also shown in FIG. 1 is an RF control pack 11 for use with printer 10, as discussed hereinbelow, to form an integrated radio-interfaced printer unit 10'. The interface elements in such a control device are well known and need not be further discussed.

The key pad 20 has a key 21 for turning the printer on, a key 23 for turning the printer off, and a key 25 for energizing a drive motor 27 for advancing the label stock. These keys may be push buttons. The drive motor 27 is a stepper motor.

Figure 5:
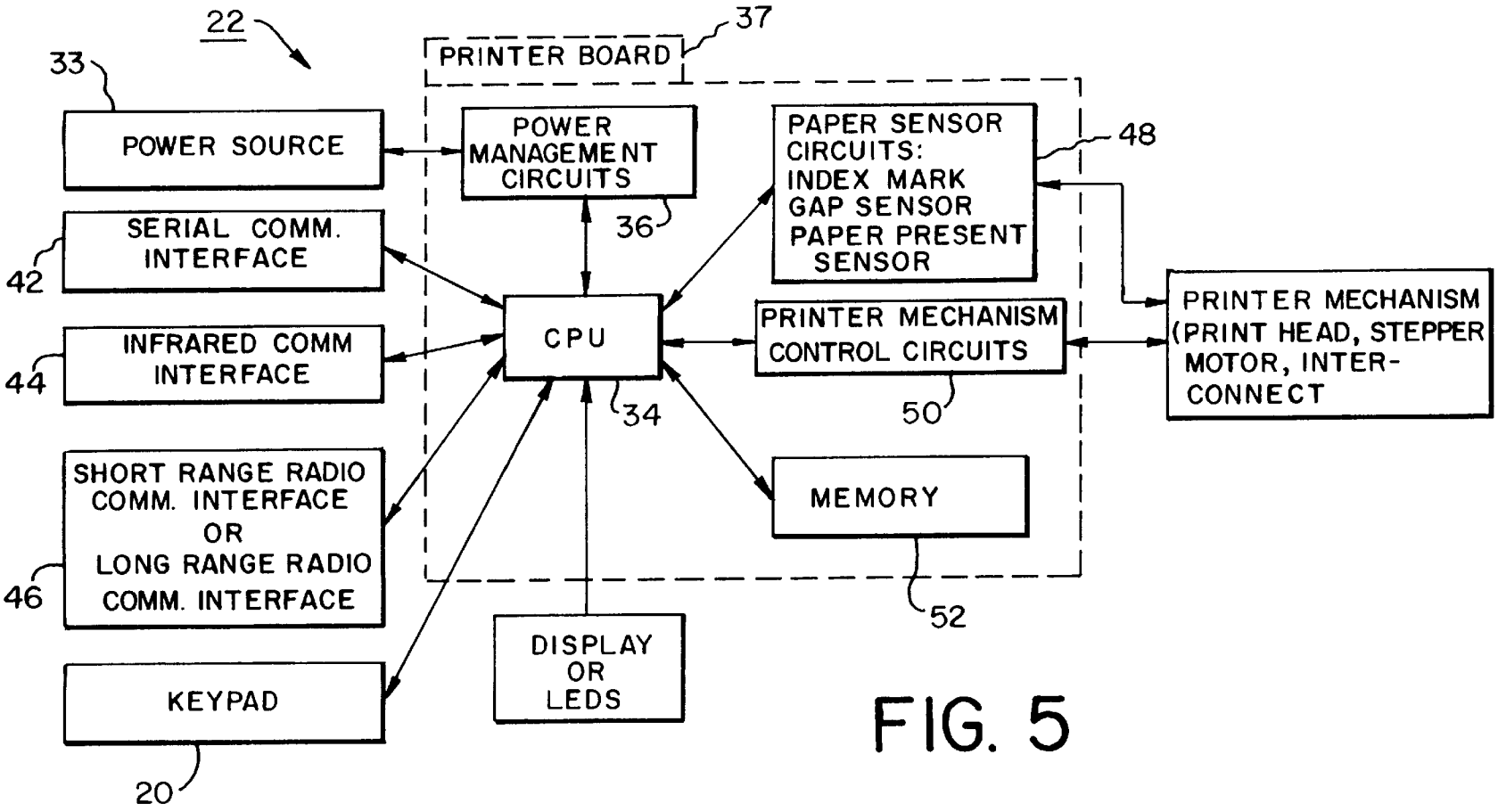
FIG. 5 is a schematic control diagram of a printer in accordance with the invention.
Figure 7:
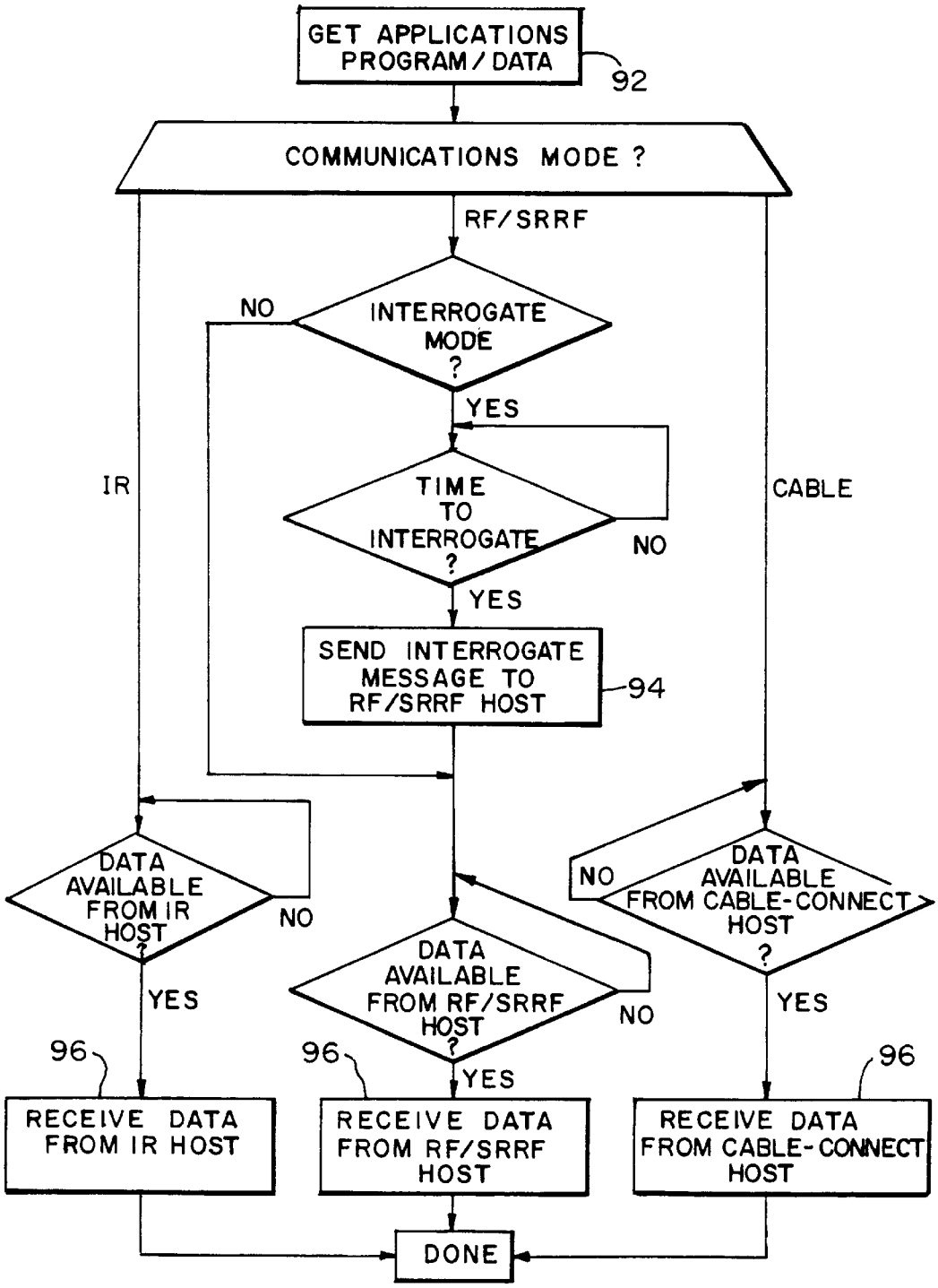
FIG. 7 is a flow chart of the "Get Application Program/Data" subroutine for checking the printer status and preparing the printer to print in the program shown in FIG. 6.

The controller assembly 22 includes the computer and input and output circuits therefrom which are illustrated in FIG. 5 and which correspond in detail with the control circuits shown in FIG. 7 in the incorporated '800 reference. The central processing unit (CPU) 34 is a microprocessor having various inputs and outputs. Power management circuits 36 control the voltage and amperage supplied to the CPU from power source 38, preferably a rechargeable battery pack 40, which is received in battery well 45 in housing 12 and retained by button 47 and latch 49. Communications interfacing with the CPU may be through a serial (cable-connect) 42, infrared (IR) 44, or radio frequency (RF) 46, either Short Range or Long Range. Key pad 20 provides commands to the CPU. The paper sensor circuits 48 control the paper-related functions: the sensing of index marks on the paper, the sensing of gaps between labels adhered to the liner, and the presence of paper in the print head. (The stock is preferably white and reflective and may have printed thereon indicia, for example, black lines between the labels, which demarcate the location of the labels. The stock also may have gaps between the labels, such gaps also constituting location indicia.) The printer mechanism control circuits 50 control the mechanical and electrical components, described hereinbelow, which advance and print the label stock. The memory 52 includes a random access memory (RAM) and a read-only memory in the form of an erasable, programmable read-only memory (EPROM).

The controller is mounted on a printed circuit board 37. The board 37 is connected to an input/output connector 39 and to an infrared sensor (not shown) behind a window 41, both of which are mounted in the front wall 43 of the housing 12. The connector and sensor also have inputs from the power management circuits 36. It may be desirable to wrap the controller board and the components mounted thereon in an electromagnetic interference (EMI) shield provided by electromagnetic field shielding material, for example, fabric covered by conductive material which is connected to ground.

The left shell 14 is molded to permit mounting of various printer components into a left-case assembly 13, and has a well 54 open at the top and left side wall 55 to receive a roll of label stock (not shown). The well 54 may include an axial mandrel 56 cantilevered on a bushing 58 from right side wall 60 to support a spooled roll of label stock. A roll is captured on the mandrel by a stock retainer collar 62 having flexible fingers 64 in a circular array These fingers extend inwardly from a flange 66 and enter between the peripheral surface of mandrel 56 and the interior peripheral surface of the roll of stock material. The flange 66 is located laterally on the collar depending upon the width of the roll of stock material.

Figure 2:
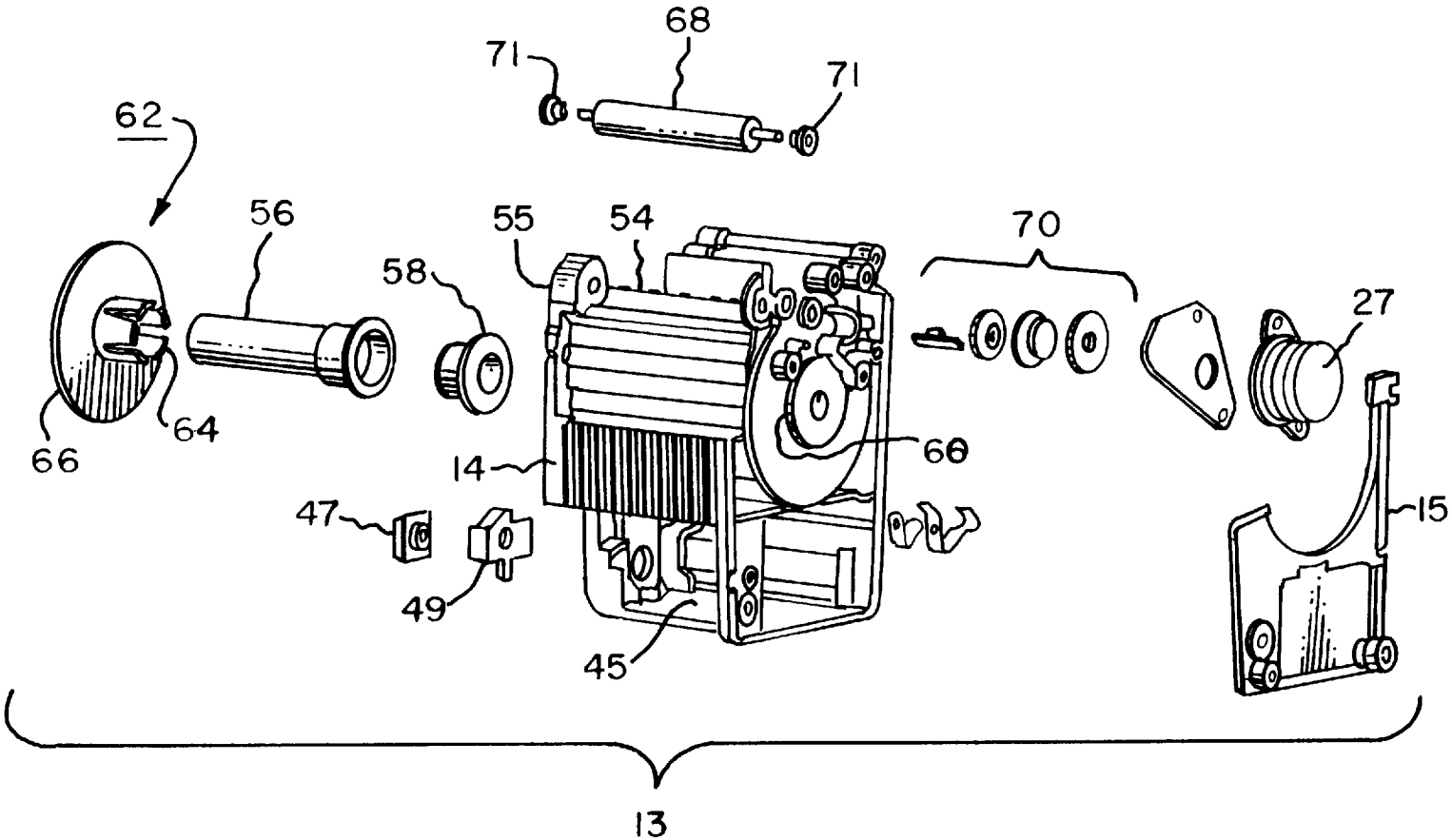
FIG. 2 is a perspective, exploded view of the printer case assembly shown in FIG. 1.
Figure 3:
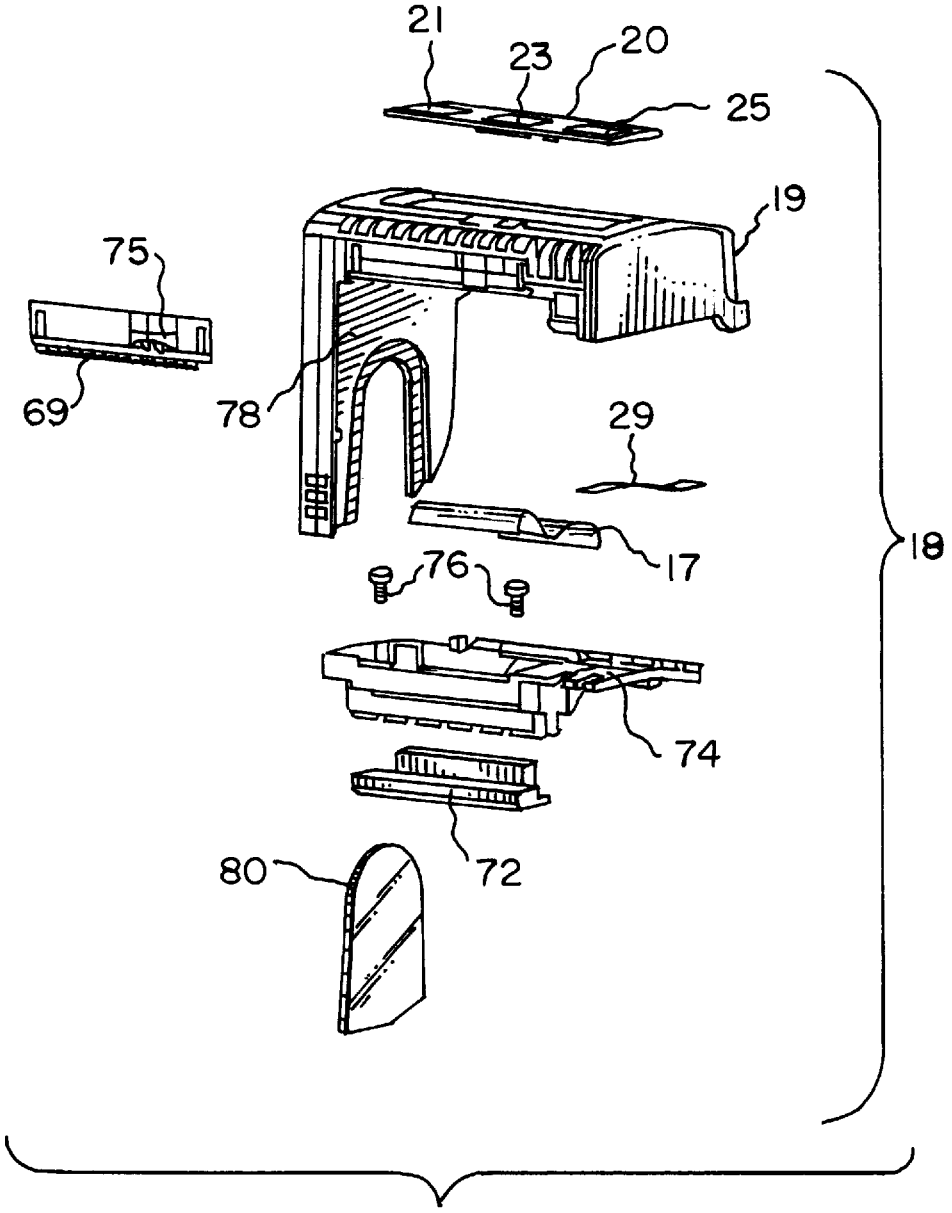
FIG. 3 is a perspective, exploded view of the top cover assembly shown in FIG. 1.

The assembly constituting the printer mechanism is shown in FIGS. 2 and 3. Stepper drive motor 27 is connected to a platen drive roller 68 by a gear train 70, which roller is journalled in bushings 71 in housing 12. Web stock to be printed proceeds along path 67 directly from stock roll 65 to platen roller 68. The thermal printer mechanism's thermal head array of printing elements 72 is disposed, in print position, adjacent to the roller 68 and acts as a pressure pad to hold the stock against the roller so that the stock may be driven by the roller. The stock is driven solely by the platen roller. Preferably, the platen roller 68 is formed from a resilient polymeric material having release properties toward adhesives commonly in use on linerless label stock, for example, a silicone polymer, which permits the conveying of adhesive-backed labels by the platen roller without fouling of the roller surface.

The thermal printer array 72 (consisting of a metal heat sink bar and an insulating bar in which a row of 384 elements is contained) is mounted in a flexural assembly within the top cover shell 19. The assembly is made of a flexural plate 74 which is thin, flexible, and arcuately curved. Plate 74 provides a biased spring on the underside of top cover shell 19, the bias of which may be set by adjustment of calibration screws 76. The thermal printing array 72 can be easily replaced by removing the calibration screws 76. This flexural mounting of the print head 72 allows the print head to float, which permits printing on different stocks having different thicknesses without adjustment of the spacing between the print head and the platen roller. The floating head configuration also prevents the printer mechanism from being affected by external pressure on cover 18, and uses leaf switch 29 to sense loss of pressure at the printing surface, which switch is coupled to CPU 34.

A serrated tear bar 69 is provided in top cover 18 for separating non-perforated or die-cut labels after printing. The top cover assembly 18 also has a side wall 78 and window 80 for covering the outer end of stock well 54 and permitting visual monitoring of the amount of label stock remaining in the well.

The presence of paper in the printer is sensed by an optical sensor 75 which does not require contact with the paper and therefore cannot be fouled by build-up of adhesive during printing. The sensor 75 is disposed preferably in top cover assembly 19, or alternatively in the printer case below the web path and just ahead of the platen roller. The sensor detects web by projecting an optical beam against the web and sensing a reflection therefrom. There is also a temperature sensor (not shown) in the print head 72 (a thermistor) which detects the temperature of the thermal head array and provides an output to the CPU 34.

Figure 4:
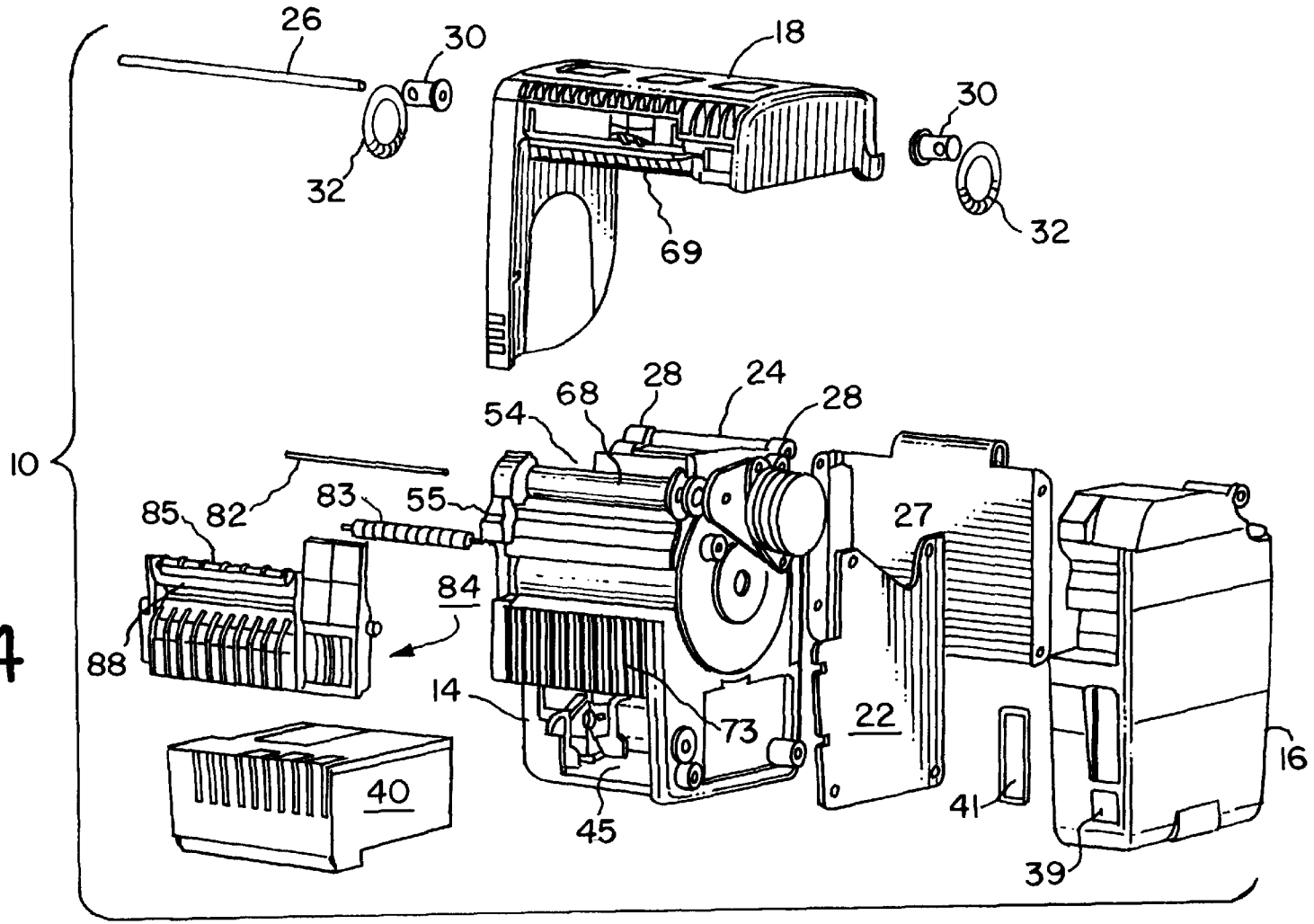
FIG. 4 is a perspective, exploded view of the entire printer assembly shown in FIG. 1.

As shown in FIGS. 1, 2, and 4, the printer is equipped with an automatic label peeler mechanism having a peeler bar 82. This bar is integral with a toggle latch assembly 84 tiltably mounted as a portion of the front wall 73 of left shell 14 for securing the top cover assembly 18 in closed, operating position. The configuration and function of the peeler bar is substantially as described in the incorporated '800 reference. Peeler bar 82 also cooperates with top cover 18 to form a first opening 86 in housing 12 when the top is closed, through which opening printed web or labels can exit the printer along path 81. A second opening 88 between first exist lip 85 and a lower portion of latch assembly 84 provides a second exit from the printer for label liner which has been separated from the label by the peeler bar and nip roller after printing of the label. Rotation of platen roller 68 thus serves to drive both the printed label from the first exit opening 86 along label path 81 and the separated label liner from the second exit opening 88 along liner path 91. Label stock may be threaded into the printer mechanism simply by opening the cover, leading the stock over the platen roller and the peeler bar, and closing the cover.

The printer 10 constitutes an integrated assembly of all the components discussed above, the principal ones of which are the electronic controller assembly, the printer mechanism including the platen roller having a releasing surface and the print head mounted in a hinged cover, and a non-contact paper-presence sensor. This integrated assembly is light in weight and may be of a weight not exceeding 1.5 pounds. The dimensions of the assembly including the battery pack may be 5.0 inches high, 3.0 inches deep, and 4.0 inches wide, the volume occupied being about 60 cubic inches (75 cubic inches with radio control pack 11.)

The printer 10 is adapted for control and to receive data representing the information to be printed from a terminal, which may contain or may be a host computer, which may be connected to the printer by way of the I/O connector 39 or the radio or IR link. The protocol for transferring digital data may be as described in the '800 patent.

Figure 6:
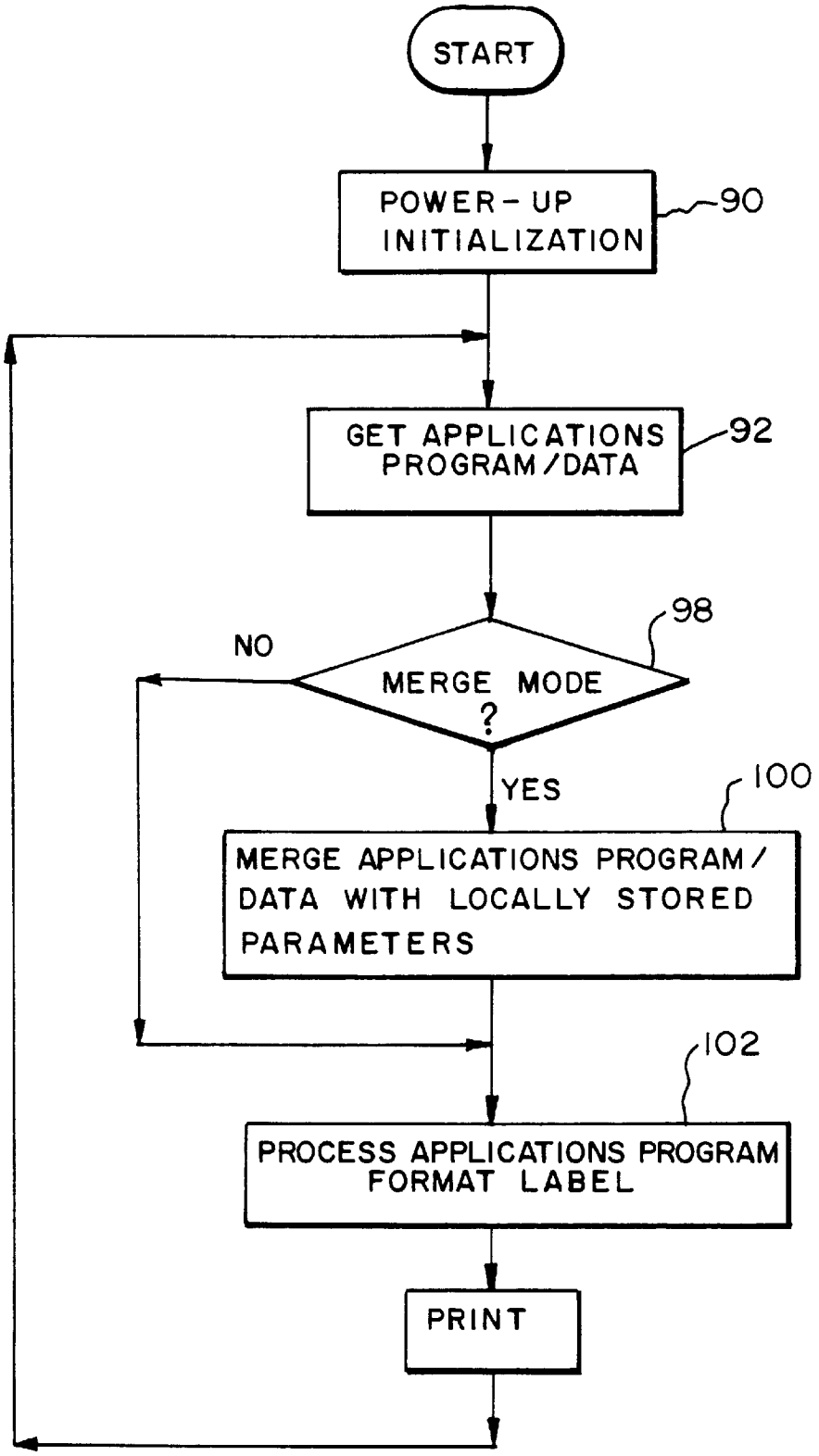
FIG. 6 is a flow chart illustrating the computer system operation (the program) for printing labels which is carried out in the computer system of a printer in accordance with the invention.

FIG. 6 shows the sequence of events after start-up necessary to prepare the printer to print. After a series of self-test parity checks and initialization 90, the controller executes the subroutine "Get Application Program/Data" 92 shown in detail in FIG. 7. After determining that the controller is ready to communicate via one of the three interface pathways (optical/infrared, cable connect, or radio), that it is in interrogate mode and that it is time to interrogate, the controller sends a request for data 94 from the terminal host, and the host replies by sending the data 96 when available. Returning to FIG. 6, after obtaining the application program or data from the host, the controller decides whether the merge mode 98 is invoked. The program and data are either used directly to establish conditions for printing or are merged 100 with the host's program and data and with other parameter data stored onboard the printer, then processed 102. The processing may be as described in the '800 patent.

Figure 8:
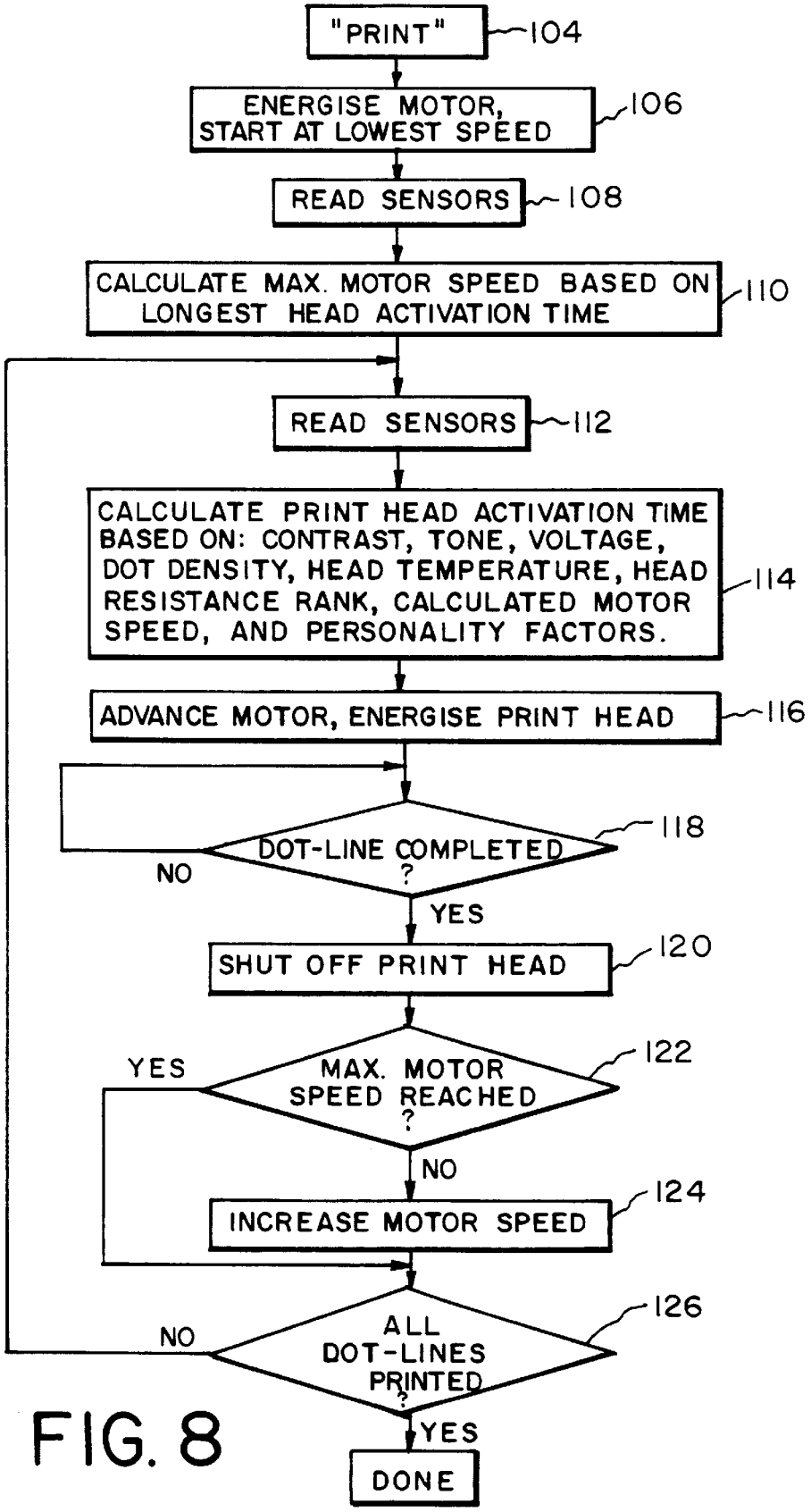
FIG. 8 is a flow chart of the "Print" subroutine for creating a label (operating the printer) which is used in the program shown in FIG. 6.
Figure 9:
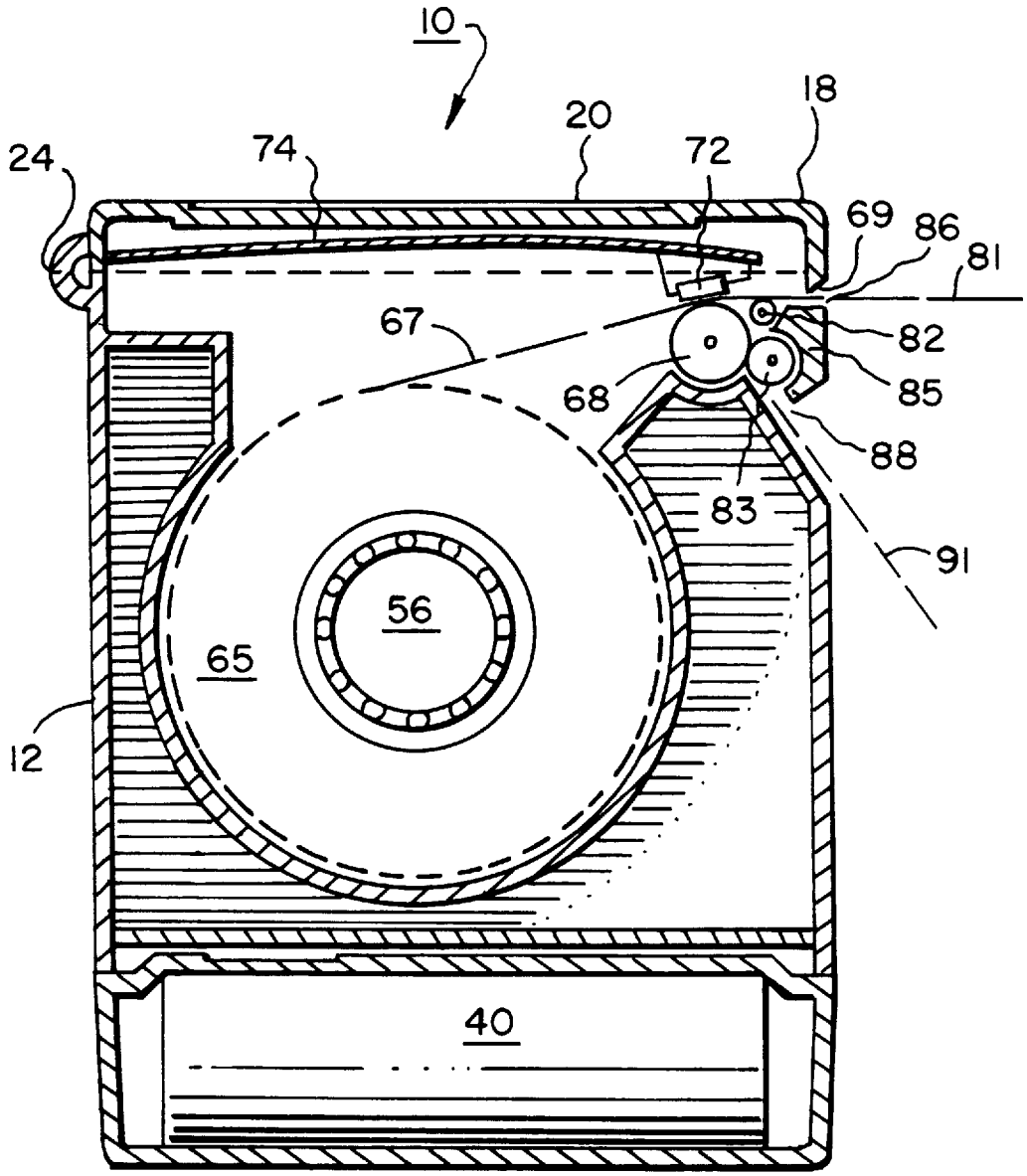
FIG. 9 is a simplified cross-sectional view of the printer shown in FIGS. 1 through 4 taken along line 9—9 in FIG. 1, showing the web path through the printer.

The sequence of events for printing a label is shown in FIG. 8. At the print command 104, the controller energizes 106 the stepper motor 27 at its lowest forward speed. Sensors for battery voltage and head temperature are read 108 and the values obtained are combined with data representing dot density. A maximum usable motor speed for printing is calculated 110 using these parameters and data in a first algorithm based on the longest activation time for the print head to be heated to a desired printing temperature. The sensors are read again 112, and a new print head activation time is calculated 114 via a second algorithm based on the above parameters, the just-calculated maximum motor speed, and data representing contrast, tone, head resistance rank, and individual printer personality factor. Then print head and motor are energized 116, and a line of printing is carried out 118, the print head energy and the motor speed being optimum for the parameters and conditions inputted to the controlling algorithms. The print head is shut off 120, and the controller interrogates whether the calculated top motor speed was reached 122. If not, the motor speed is increased 124 and another line of dots is printed. When the proper motor speed has been reached, all printing is carried out 126 and the printer is shut down.

The label is printed by reading out data from memory into the head array. The data is successively printed to create (print) the label. The motor is energized and advances until a first indicium on the web is encountered, or for a preset length of web stock, to index the web in the printer mechanism. The requested label quantity is decremented and if the quantity is greater than zero, the process returns to print the same material on the next label. If the new label is to be printed with fresh material, the check status routine is again invoked. However, before reprinting, the reset bit can be checked because, if it is high, the printer has been powered off and then on. This is quite likely, since it is desirable to turn the printer off, except when it is to print a label, for battery power conservation. An acknowledge command is received from the terminal to assure that the terminal's program to output data and commands for the label will be transmitted to the printer.

A printer in accordance with the invention may be employed as one of a network of printers, all in communication with a central computer terminal or a plurality of terminals. Communications means (type of interface: RF, IR, or cable) is preferably the same for all printers. The printers in the network may be addressed individually or collectively by the terminal to print different or identical labels. Each printer is able to distinguish data provided to it by the terminal from data being provided to other printers, is able to print that associated data, and is able to acknowledge to the terminal that the data were successfully printed.

From the foregoing description it will be apparent that there has been provided an improved printer which may be implemented as a miniature, portable, intelligent, and interactive device. Variations and modifications of the herein described printer within the scope of the invention will undoubtedly suggest themselves to those skilled in this art. Accordingly, the foregoing description should be taken as illustrative and not in a limiting sense.

We claim:

1. A printer responsive to data representing information to be printed on linered or linerless adhesive-backed label web stock and to programming and information data from a computer terminal, said printer comprising:

a) a printer mechanism having printing elements including a platen roller having a surface which is non-adhereable by label adhesives and a floating print head;

b) a receptacle for receiving a roll of web stock on which printing is carried out on successive lines by said printing elements of said printer mechanism, said printer mechanism having means for feeding the stock along a web path past said printing elements;

c) an electronic controller responsive to said data for operating said printer mechanism; and d) a housing containing said printer mechanism, said receptacle, and said controller which together comprise an integrated assembly having a weight not exceeding about 1.5 pounds and a volume not exceeding about 60 cubic inches, said housing including a case and a top cover openably and electrically attached to said case to expose said platen roller, said top cover containing a flexural mounting for flexibly supporting said floating print head against said platen roller, said case having opposite side walls, a front wall and a rear wall, a first opening between said front wall and said openable cover, and means in said housing defining said path of travel for said web stock through said printer mechanism and said first opening between said cover and said case.

2. The printer according to claim 1 wherein said receptacle is a well in said housing case accessible from one side thereof.

3. The printer according to claim 2 wherein said well includes a fixed mandrel for receiving said roll of web stock.

4. The printer according to claim 3 further comprising a tubular collar having a flange which is received around said mandrel between said roll of stock and said mandrel with said flange against an edge of said roll for mounting said roll on said mandrel notwithstanding the axial length of said roll.

5. The printer according to claim 1 wherein said controller has means for generating data representing the operating state of said printer mechanism and for transmitting said state data to said terminal.

6. The printer according to claim 1 wherein said platen roller is rotatably disposed in said case and extends across said first opening and a print head is disposed on an inner surface of said cover, said platen roller being driven by a drive motor to advance said label stock through said printer in response to commands from said electronic controller.

7. The printer according to claim 1 wherein said flexural mounting in said top cover includes a flexural plate for carrying said print head and for providing a compressible spring disposed between said print head and said top cover for urging said print head toward said platen roller.

8. The printer according to claim 1 wherein said non-adhereable surface includes a silicone polymer.

9. The printer according to claim 1 wherein said web stock has opposite surfaces one of which is provided with an adhesive, which adhesive surface is disposed on said platen roller surface as said web travels around said roller along said path.

10. The printer according to claim 6 wherein said flexural assembly further comprises said openable top cover being pivotably attached to said case by a hinge to provide a first open position of said cover wherein said receptacle, said print head, and said platen roller are exposed, and a second closed position of said cover wherein said receptacle is covered, said first opening is formed, and said print head is positioned adjacent said platen roller, a portion of said path of travel for said web passing between said print head and said platen roller.

11. The printer according to claim 10 further comprising a latch for retaining said cover in said closed position.

12. The printer according to claim 1 further comprising water resistant seals between said top cover and said case.

13. The printer according to claim 1 further comprising a window in a wall of said printer to permit visual monitoring of a remaining amount of said web stock.

14. The printer according to claim 1 further comprising a non-contact sensor for sensing the presence of web at the printer mechanism.

15. The printer according to claim 14 wherein said non-contact sensor is disposed in said top cover.

16. The printer according to claim 6 wherein said web is linered label stock having opposite surfaces a first one of which is disposed on said roller as said web travels around said roller along said path and the second of which has labels releasably attached thereto, said printer further comprising a peeler bar disposed in off-spaced and substantially parallel relationship to said roller in said web path downstream of said printing elements, said web path forming an angle around said peeler bar to cause said labels to separate from said second surface, said printer further comprising a first exit lip in said first opening, said lip extending across said first opening with said lip adjacent to said peeler bar and a central portion of said lip being off-spaced from said case to define a second opening through which said label liner may pass while said separated labels pass through said first opening.

17. The printer according to claim 16 wherein said first exit lip has a plurality of ribs extending away from said peeler bar.

18. The printer according to claim 1 further comprising a battery pack attachable to said housing as an additional part of said assembly for powering said mechanism and said controller, said assembly of said printer and said battery pack not exceeding said weight and volume.

19. The printer according to claim 1 further comprising keypad means representing keys for providing signals to said controller, said keypad means being disposed on said housing on an exterior surface thereof.

20. The printer according to claim 19 wherein said keypad means is disposed on said top cover, said key pad being connected to said controller.

21. The printer according to claim 1 wherein said web has opposite surfaces on one of which labels which are printed by said printing elements of said printing mechanism are releasably and adhesively attached, said web having at least one repeating indicium across said web and disposed in spaced relationship with said labels to indicate the location of said labels on said web, said printing mechanism having means for detecting said indicium, and means in said controller responsive to said detecting means for operating said mechanism to feed said web to locate said labels individually with respect to said printing elements.

22. The printer according to claim 1 wherein said indicium is selected from the group consisting of printed lines and label gaps.

23. The printer according to claim 22 wherein said controller includes means for feeding said web for a given length or until one of said indicia is detected, whichever occurs first.

24. The printer according to claim 21 wherein said controller has means for counting the number of said indicia which are detected, and means for recording the length of paper which travels past said printing mechanism corresponding to said number of indicia.

25. The printer according to claim 1 further comprising a radio-frequency (RF) transceiver attachable to said housing as an additional part of said assembly for RF communication of signals between said terminal and said microprocessor.

26. The printer according to claim 25 wherein said printer assembly including said RF transceiver weighs less than 2 pounds and occupies a volume of less than 75 cubic inches.

27. The printer according to claim 1 further comprising a non-contact infra-red (IR) transceiver attachable to said housing as an additional part of said assembly for IR communication of signals between said terminal and said microprocessor.

28. The printer according to claim 16 wherein said angle is an obtuse angle.

29. A printer having a housing containing a printing mechanism having printing elements and an electronic controller including a microprocessor for receiving programming and information data from a terminal for operating said printing mechanism, and means for holding a web of stocks for receiving printing, wherein said controller has a data input line for receiving data from said terminal, a data output line for transmitting data to said terminal, said operating programs and said data for operating said printing mechanism being received by said controller on said data input line and said data representing the operating state of said machine being transmitted by said controller on said data output line, said controller having means responsive to control commands selected from the group consisting of a print contrast command, a command to control printing effects, a command to control a paper-presence sensor, and a battery level reporting command, said controller determining the status of a plurality of operating parameters, said controller and merging said programming and information data from said terminal with said control commands and said operating parameter status to cause said printer to operate at the maximum permissible printing speed, and said controller having means for generating multi-bit data signals different bits of which represent status data consisting of data representing the printing mechanism being busy in process of printing, the web being out of said printing mechanism, the printing elements being in position to print, and the print contrast.

30. The printer according to claim 29 wherein said controller has an input line from said terminal for commanding said controller to apply power to said printing mechanism, and such controller has an output line to said terminal for a signal indicative of whether said printing mechanism is on or off.

31. The printer according to claim 29 wherein said controller has an input line from said terminal for a signal indicative of whether the terminal is ready to send commands and data, and said controller has an output line to said terminal for a signal indicative of whether said printer is ready to accept said commands and data.

32. The printer according to claim 29 wherein said controller includes a microprocessor wherein data representing a block of information for operating said printing elements is stored and a memory associated with said microprocessor wherein instructional data is formated into bar code, graphics, text, or lines for printing.

33. The printer according to claim 29 wherein said controller has means responsive to a web feed direction command, said controller having means for generating multi-bit data signals different bits of which represent status data representing the feed direction of said web.

34. The printer according to claim 29 wherein said controller has means responsive to a serial number of the printer reporting command.

35. The printer according to claim 29 wherein said controller has means responsive to a total length of web printed reporting command.

36. The printer according to claim 29 wherein said controller has means for generating multi-bit data signals different bits of which represent status data consisting of data representing the power to said controller having been turned off and then on again.

37. The printer according to claim 29 wherein said microprocessor is programmed to use data representing values for at least one of print head temperature and head resistance rank, and data representing defined parameters for desired contrast and tone, and also data representing battery voltage, dot density, printer personality, and motor speed to determine the energy to be supplied to the print head.

38. A method for maximizing motor speed and optimizing energy applied to a print head in a printer, comprising the steps of:

a) measuring operating parameters in said printer including battery voltage, print head temperature, and dot density;

b) first calculating said maximum motor speed using said measured operating parameters;

c) providing data representing contrast, tone, and head resistance rank; and d) second calculating the energy to be applied to said print head by combining said measured operating parameters, said maximum motor speed calculated on said first calculating step, and said provided data.

39. The method of claim 38 further comprising controlling head strobing times in accordance with said second calculating step.

* * * * *